US007466240B2

(12) United States Patent
Evans et al.

(10) Patent No.: US 7,466,240 B2
(45) Date of Patent: Dec. 16, 2008

(54) WIRELESS SENSING NODE POWERED BY ENERGY CONVERSION FROM SENSED SYSTEM

(75) Inventors: James William Evans, Piedmont, CA (US); Michael Harris Schneider, Emeryville, CA (US); Daniel Artemis Steingart, Berkeley, CA (US); Paul K. Wright, Oakland, CA (US); Donald P. Ziegler, Lower Burrell, PA (US)

(73) Assignees: The Retents of the University of California, Oakland, CA (US); Alcoa Technical Center, Alcoa Center, PA (US)

( * ) Notice: Subject to any disclaimer, the term of this patent is extended or adjusted under 35 U.S.C. 154(b) by 163 days.

(21) Appl. No.: 11/335,019

(22) Filed: Jan. 18, 2006

(65) Prior Publication Data

US 2006/0176175 A1 Aug. 10, 2006

Related U.S. Application Data

(60) Provisional application No. 60/647,176, filed on Jan. 25, 2005.

(51) Int. Cl.
*G08C 19/12* (2006.01)

(52) U.S. Cl. ..... 340/870.17; 166/250.02; 340/870.16; 136/205

(58) Field of Classification Search ..... 340/870.02, 340/870.16, 870.17; 166/250.02; 136/205
See application file for complete search history.

(56) References Cited

U.S. PATENT DOCUMENTS 4,940,976 A * 7/1990 Gastouniotis et al. .. 340/870.02
6,053,163 A * 4/2000 Bass ..... 126/312

(Continued)

OTHER PUBLICATIONS

Meier, Rene, et al., "Steam: Event-Based Middleware for Wireless Ad Hoc Networks", Department of Computer Science, Trinity College; Dublin, Ireland; publication date: 2002, http://ieeexplore.ieee.org/xpl/freeabs_all.jsp?arnumber=1030841: pp. 639-644.

(Continued)

*Primary Examiner*—Albert K Wong
(74) *Attorney, Agent, or Firm*—Charles J. Kulas; Brian N. Young; Trellis IP Law Group, PC

(57) ABSTRACT

A sensing system for sensing conditions or characteristics associated with a process or thing. The sensing system includes one or more energy converters and a sensor, which are coupled to the process or thing. A node is coupled to the sensor and the energy-converter, and the node is powered by output from the energy converter. In a more specific embodiment, the node includes a controller that implements one or more routines for selectively powering a wireless transmitter of the node based on a predetermined condition. The predetermined condition may specify that sensor output values are within a predetermined range or are below or above a predetermined threshold. Alternatively, the predetermined condition may specify that electrical energy output from the energy converter is below a predetermined threshold. A remote computer may be wirelessly connected to node and may include software and/or hardware that is adapted to process information output by the sensor and relayed to the computer via the node.

48 Claims, 4 Drawing Sheets

U.S. PATENT DOCUMENTS

| | | | | |
|---|---|---|---|---|
| 7,228,902 | B2 * | 6/2007 | Oppelt | 166/250.02 |
| 2005/0139248 | A1 * | 6/2005 | Strnad | 136/205 |
| 2005/0146220 | A1 * | 7/2005 | Hamel et al. | 307/44 |
| 2005/0213548 | A1 * | 9/2005 | Benson et al. | 370/338 |

OTHER PUBLICATIONS

Dando, Neal R.; Using Fume Duct Temperatures for Minimizing Open Holes in Pot Cover; Light Medals 2004; p. 245-248.

* cited by examiner

WIRELESS SENSING NODE POWERED BY ENERGY CONVERSION FROM SENSED SYSTEM

CLAIM OF PRIORITY

This invention claims priority from U.S. Provisional Patent Application Ser. No. 60/647,176 entitled WIRELESS MEASUREMENT OF OPERATING PARAMETERS, filed on Jan. 25, 2005 which is hereby incorporated by reference as if set forth in full in this application for all purposes.

BACKGROUND OF THE INVENTION

This invention is related in general to sensing systems and more specifically to networks used to sense conditions or characteristics associated with a process or thing.

Sensing systems are employed in various demanding applications including alumina-processing plant instrumentation, wildfire detection and monitoring; and weather monitoring and forecasting. Such applications often demand versatile sensing systems that can readily provide valuable information to improve predictions, manufacturing techniques, and so on.

Versatile and efficient sensing systems are particularly important in aluminum oxide (alumina) processing applications, where extreme operating conditions involving high voltages and temperatures often preclude use of potentially unsafe, bulky, or cumbersome sensing systems. An exemplary alumina-processing plant includes plural aluminum-reduction cells, also called pots or Hall-Héroult cells. A Hall-Héroult cell includes an electrolyte containing alumina. An electrical current passes through the solution between a carbon anode and a carbon cathode, causing a chemical reaction between alumina and carbon, yielding carbon dioxide gas and aluminum.

Unfortunately, conventional sensor systems for measuring Hall-Héroult cell process characteristics, such as temperature, cell voltage, exhaust-gas pressure, and so on, often require wires that connect the sensors to one or more computers. Additional wires connect the sensors to power sources. The hardware required to implement such sensing systems in Hall-Héroult-cell applications may create safety concerns, interfere with existing hardware, require excessive maintenance, and consume excessive power.

Accordingly, Hall-Héroult-cells are often equipped with relatively few sensors due to such problems. Consequently, sensed data that could yield improvements in cell-energy efficiency is often unavailable.

SUMMARY OF EMBODIMENTS OF THE INVENTION

Embodiments of the invention provide a sensing system for sensing conditions or characteristics associated with a process or thing, such as, but not limited to, an aluminum-reduction process occurring in a Hall-Héroult cell. The sensing system includes one or more energy converters, which may include a thermoelectric generator. The sensing system further includes at least one sensor that is coupled to the process or thing (i.e., the "sensed system," as distinct from the "sensing system"). A node, which is associated with a wireless transmitter/receiver or a mote processor radio, is coupled to the sensor and the energy-converter. The node is powered by output from the energy converter, which is also coupled to the process or thing.

Energy can be obtained from any suitable property, characteristic or effect of the sensed system. For example, heat, vibration, chemical, electrical, magnetic, electromagnetic, nuclear, gravitational, or other characteristics of the sensed system may be used as an energy source. Differentials in temperature, pressure, electrical charge, acidity, flux, etc., can be used to derive energy for powering various components or functions in various embodiments of the invention. One or more characteristics of the sensed system can be used to provide a power source to one or more sensors, nodes or other components. Components can sense characteristics that are the same or different from the characteristics used to provide power.

In the specific embodiment, the node includes a controller that implements one or more routines for selectively adjusting power to a wireless transmitter of the node in response to a predetermined condition. The predetermined condition may specify that sensor output values are within a predetermined range or below or above a predetermined threshold. Alternatively, the predetermined condition may specify that electrical energy output from the energy converter is below a predetermined threshold. A remote computer may include one or more routines that are adapted to process information output by the sensor and forwarded to the computer by the transmitter included in the node.

In a more specific embodiment, the system includes an apparatus comprising: a sensor for sensing a characteristic of a process; a thermoelectric generator having first and second temperature sources, wherein the first temperature source is obtained from the material or object being sensed by the sensor; and a wireless transmitter coupled to the thermoelectric generator and the sensor, wherein the wireless transmitter obtains power from the thermoelectric generator for transmitting an indication of the sensed characteristic from the sensor to a receiver.

Another embodiment provides a method for obtaining a sensor reading, the method comprising: using a thermoelectric generator to generate electrical energy, wherein the thermoelectric generator obtains heat from a source; using a sensor to measure a characteristic of the source; and using a wireless transmitter powered by the electrical energy to transmit the measured characteristic.

Another embodiment includes attaching (e.g. with a magnet) the thermoelectric generator to a hot surface on the cell exterior so as to provide electrical power to a sensor/wireless transmitter that is integral with the generator or nearby and electrically connected to it, the sensor measuring some process variable such as the heat flux from the exterior of the cell.

Hence, embodiments of the present invention provide an efficiently powered sensing system that obviates the need for potentially dangerous wires and power sources. Embodiments of the present invention may provide a relatively safe and cost-effective sensing platform that provides minimal interference with accompanying plant operations. Furthermore, the sensing system may reduce energy consumption and associated costs by efficiently utilizing waste energy from existing processes.

DESCRIPTION OF EMBODIMENTS OF THE INVENTION

For clarity, various well-known components, such as amplifiers, communications ports, Internet Service Providers (ISPs), and so on have been omitted from the figures. However, those skilled in the art with access to the present teachings will know which components to implement and how to implement them to meet the needs of a given application.

Figure 1:
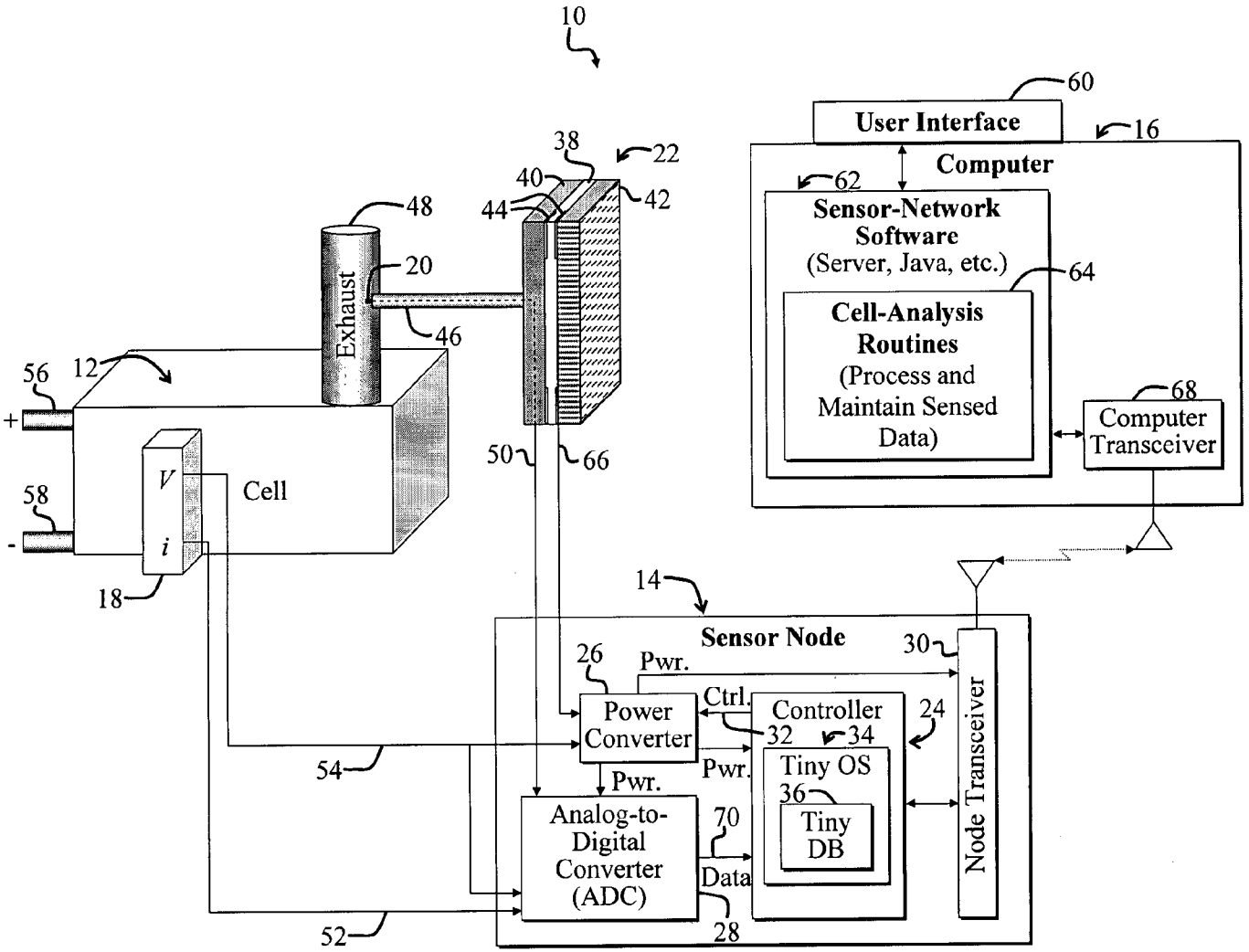
FIG. 1 is a diagram of a sensing system adapted for use with Hall-Héroult cell according to a first embodiment of the present invention.

FIG. 1 is a diagram of a sensing system 10 adapted for use with Hall-Héroult cell 12 according to a first embodiment of the present invention. In the present specific embodiment, the system 10 includes a sensor node 14 in communication with a computer 16, a cell-voltage-measuring device 18, a thermistor, thermocouple, or other temperature measurement device 20, and a thermoelectric generator assembly 22.

The sensor node 14 includes a node controller 24, which communicates with a power converter 26 and receives input from an Analog-to-Digital Converter (ADC) 28. The node controller 24 also communicates with a node transceiver 30. The node controller 24, transceiver 30, and ADC 28 are powered by output from the power converter 26. The node transceiver 30 implements a wireless transmitter and receiver for transmitting and receiving wireless signals to and from a computer transceiver 68 of the computer 16. One skilled in the art may implement the power converter 26 via a step-up DC-DC converter.

In the present specific embodiment, the controller 30 runs various software and/or hardware, including a Tiny OS (Operating System) 34, which supports Tiny DB (DataBase) 36. The power converter 26 receives control signals 32 from the controller 34, which may be generated via various routines, including Tiny DB routines 36, that selectively control power output from the power converter 26 to the transceiver 30, ADC 28, and various sensors 18, 20, as discussed more fully below.

In the present specific embodiment, the node controller 24 employs custom software running on the Tiny OS 34, which implements the Tiny-DB Application Programming Interface (API) software 36 and further executes the following actions, which also accommodate sensing systems with multiple nodes as discussed more fully below:

1) Presents a setup Graphical User Interface (GUI) for a user to select and input various variables (such as, but not limited to, sampling frequency, etc.), and to select process parameters, such as temperature, to monitor.
2) Displays received data from each node, including the date and time, query number, each node's identification number, selected process parameters, thermoelectric generator power output information, and information pertaining to a parent node over which the node hopped across to reach the computer 16 as discussed more fully below.
3) Stores the received data into a spreadsheet format and/or text file.
4) Creates a new file for every 12 hours and statistically analyzes the previous file.
5) May run three separate GUIs that a) display the current node statistics, b) illustrate a real-time network visualization between each node and the central computer 16, and c) allow the operator to monitor an individual node's sensed values over a specified period of time.

The Tiny DB 36 may implement a query processing system for extracting information from a network of nodes, as discussed more fully below, of which the sensor node 14 may be a part. The Tiny DB 36 may be implemented via a readily available programmable application that provides various features including:

1) Does not require a programmer to write embedded C code for sensors.
2) Presents a simple language for extracting data
3) Provides a Java API (Application Programming Interface) for simplifying the coding of Personal-Computer (PC) applications.
4) Provides the ability to autonomously network an ad-hoc assortment of nodes and to route data from the nodes via hopping to a central server, such as the computer 16.
5) Provides power-efficient algorithms which place an accompanying node, such as the sensor node 14, automatically into a low-power sleep mode when the node is not collecting, transmitting, or receiving data.

The power converter 26 receives input 66 from a thermoelectric generator layer 38 that is sandwiched between a hot plate 40 and a heat sink 42 of the thermoelectric generator assembly 22. The hot plate 40, heat sink 42, and thermoelectric generator layer 38 may be attached to the object or system being sensed by magnets 44. For illustrative purposes, the power converter 26 is also shown receiving input 52, 54 from the cell-voltage-measuring device 18.

The ADC 28 receives analog input 50, 52, 54 from sensors, including the temperature measuring device 20, which acts as a temperature sensor, and the cell-voltage measuring device 18, which acts as a voltage and/or current sensor. In an alternative operative scenario, the cell-voltage-measuring device 18 also provides electrical energy 54 to the power converter 18 to facilitate powering the node 14 and accompanying sensor 20 as needed.

The ADC 28 converts analog inputs 50, 52, 54 into digital signals, which are provided to the node controller 24. The node controller 24 may store resulting digitized sensed data 70 and/or may forward the sensed data 70 to the computer 16. In the present specific embodiment, the analog inputs 50, 52, 54 include cell current 52 and cell voltage 54 between an anode conductor 56 and a cathode conductor 58 of the cell 12. The analog inputs 50, 52, 54 further include sensed temperature data 50 from the thermistor 20.

The hot plate 40 of the thermoelectric generator assembly 22 is thermally coupled to thermally conductive extension 46, which may be constructed via various materials, such as, but not limited to, copper. The extension 46 extends from the hot plate 40 to within an exhaust duct 48 of the cell 12 and conducts heat therebetween. The thermistor 20 is connected to the end of the conductive extension 46 and is exposed to the interior of the exhaust duct 48. Sensed temperature data 50 pertaining to the temperature inside the exhaust duct 48 is forwarded to the ADC 28 of the node 14.

The computer 16 includes a user interface 60 and sensor-network software 62, including cell-analysis routines 64 for selectively querying the sensor node 14; for analyzing sensed data from the sensor node 14; for implementing Application Programming Interfaces (APIs); for implementing server functions; for enabling programmability via Java®, and so on. Exact details of the functionality and hardware and/or software 62 of the computer 16 are application-specific and may be adjusted by those skilled in the art without departing from the scope of the present invention.

Exact connection details between modules, such as modules 12, 14, 16, 22, are application specific and may be changed to meet the needs of a given application without departing from the scope of the present invention. For example, output from the cell-voltage-measuring device 18 may not be input to the power converter 26 of the node 14 in certain applications. Furthermore, some modules may be omitted, or the locations of certain modules may be changed without departing from the scope of the present invention. For example, the cell-voltage-measuring device 18 may be omitted and/or the power converter 18 may be positioned separately from the node 14.

In operation, the thermoelectric generator assembly 22 converts heat energy from within the exhaust duct 48 into electrical energy, which is provided to the power converter 18 of the node 14 via a power signal 66. For the purposes of the present discussion, electrical energy may be any energy provided via electrical current, a voltage differential, or via a wireless electromagnetic energy. The hot plate 40 and the relatively cool heat sink 42 provide a sufficient temperature differential to enable the thermoelectric generator layer 38 to provide sufficient output power to power the node 14. Power provided by the thermoelectric generator assembly 22 may also be used to power sensors, such as the thermistor 46, which may require additional power input, as discussed more fully below.

The node controller 24 runs routines for controlling the power, i.e., electrical energy provided to the node transceiver 30 based on sensed data reported from the sensors 18, 20, power levels provided by the thermoelectric generator assembly 22, and so on. The node controller 24 may run routines for only powering-on the transceiver 30 when sensed data from the sensors 18 and/or the power levels provided by the thermoelectric generator assembly 22 meet predetermined criteria as discussed more fully below. Such criteria may be adjusted to meet the needs of a given application.

The software running on the node controller 24 may be programmed via an external computer, such as the computer 16, that may plug into the node 14 or may otherwise wirelessly communicate with the node 14. Use of Tiny OS 34 and accompanying Java® functionality facilitate node programmability.

Hence, the system 10 implements a system for obtaining information pertaining to a process or thing. In the present embodiment, the process is a Hall-Héroult aluminum-reduction process implemented via the cell 12. The system 10 implements a first mechanism 22 for employing energy from the Hall-Héroult aluminum-reduction process to generate a signal corresponding to the power signal 66 and/or the voltage signal 54 output by the thermoelectric generator assembly 22 and/or the cell-voltage measuring device 18, respectively. For the purposes of the present discussion, a power signal may be any signal sufficient to power a circuit or other device. Power represents electrical energy per unit time.

A second mechanism 18, 20 senses a condition pertaining to the process or thing 12 and provides sensed information 50, 52, 54 in response thereto. A third mechanism 14, 16 collects the sensed information. A fourth mechanism 18 employs the signal 54, 66 to power the second mechanism 20 and/or the third mechanism 14, 16 as needed.

The third mechanism 14, 16 includes the sensor node 14. For the purposes of the present discussion, a sensor node may be any device that communicates with one or more other devices via one or more communications links, where the device is connected to a sensor.

The energy from the Hall-Héroult aluminum-reduction process used to power the system 10 represents waste energy. For the purposes of the present discussion, waste energy may be any energy that is not fully utilized by a process or device. Examples of waste energy include, but are not limited to, excess heat, vibration, and gas pressure associated with an alumina reduction cell, such as the cell 12. In the present specific embodiment, the waste energy employed by the system 10 is heat energy from the exhaust duct 48 and/or excess electrical energy from the cell 12 as provided by the cell-voltage-measuring device 18. Other types and/or sources of energy may be employed by the system 10 without departing from the scope thereof. For example, other forms of waste heat, such as heat conducted through walls or the bottom of the cell 12 may be employed to generate electrical energy.

Various sensors may be included addition to the temperature sensor, i.e., thermistor 20, and the voltage sensor 18 as discussed more fully below. Examples of additional sensors include a chemical sensor, a gas-flow sensor, a voltage sensor, and/or a current sensor.

The node controller 24 runs software 34, 36, which is adapted to selectively adjust power to the wireless transceiver 30 based on one or more predetermined conditions. In the present specific embodiment, the predetermined conditions include a power level associated with the power signal 66 being below a predetermined threshold. When this occurs, the power provided to the node transceiver 30 is reduced or shut off. The predetermined conditions may also include sensor-output status. For the purposes of the present discussion, sensor-output status may include information pertaining to the output of a sensor, including magnitudes of sensed-data values, existence of sensed data, sensed-data values as compared to specific thresholds, and so on.

For example, in the present operative scenario, if the temperature reported by the thermistor 20 is outside of a desired range, the controller 34 may adjust or calibrate various operating conditions or parameters of the node 14 and/or accompanying sensors 18, 20 to bring temperature measurements within range. Examples of parameters include transmit power, data-reporting times, temperature values, types of data reported, and so on.

The present embodiment addresses various concerns prevalent in many alumina-reduction plants. Such concerns mandate: minimizing costs for each sensing system for each cell, since a given plant may have multiple cells; maximizing safety, since dangerously high temperatures may exist within and around cells and since problems associated with placing wires carrying signals can potentially lead to dangerous voltages nearing a thousand volts; labor and costs associated with placing wires should be minimized; and use of bulky batteries and wall-socket power sources should be minimized, since use of such power sources may present a substantial operating nuisance and expense when large numbers of cells and sensing systems are considered. The sensing system 10 of FIG. 1 addresses these issues by providing a cost-effective and relatively safe wireless sensing system 10 that is efficiently powered by waste energy or other energy inherent in the alumina-reduction process.

Use of the sensing system 10 may provide various additional benefits. For example, one can deduce electrolyte ledge thickness (not shown) within the cell 12 through heat flux measurements provided by the thermistor 20, which may be considered a heat flux sensor. Accurate determination of the thickness of an electrolyte ledge formed within the cell 12 may facilitate predicting failure of the cell 12.

Those skilled in the art may readily employ an off-the-shelf Mote Processor Radio (MPR) to facilitate implementing the node 14. An exemplary MRP is the standard mica2 mote, which is supplied by Crossbow Technology, Inc., model # MPR400 (FIG. 1*a*). The MPR400 comes standard with a 10 bit ADC converter (~3 mV precision), Digital Input/Output, Universal Asynchronous Receiver and Transmitter (UART), 3 Light-Emitting-Diodes (LEDs), a Frequency-Modulation (FM) tunable radio, Flash Data Logger Memory (FDLM), and a basic whip antenna. Without obstructions, the mica 2s purportedly can transmit data up to 500 feet away. Standard 2 AA batteries and a battery holder that accompany the mica2s may be removed for embodiments of the present invention.

Other types of motes or nodes, other than mica2s, may be employed to implement embodiments of the present invention without departing from the scope thereof. For example, those skilled in the art may custom build the node 14 to meet the needs of a given application.

Additional sensor-network details that may be employed to facilitate implementing embodiments of the present invention are described in the following papers, which are each hereby incorporated by reference as if set forth in full in this application for all purposes:

1. "DESIGN AND IMPLEMENTATION OF A THERMOELECTRICALLY-POWERED WIRELESS SENSOR NETWORK FOR MONITORING THE HALL-HEROULT PROCESS," (53 pages) Michael H. Schneider, 2003;
2. "EXPERIMENTS ON WIRELESS INSTRUMENTATION OF POTLINES," (6 pages) Schneider, Evans, Ziegler, Wright, Steingart, 2005; and
3. "WIRELESS MEASUREMENT OF OPERATING PARAMETERS OF HALL CELLS," (2 pages).

Hence, FIG. 1 illustrates a basic configuration of a temperature sensor 20 and associated transmitter 30 that are powered by waste heat from the exhaust duct 48. The thermoelectric generator layer 38 is positioned between the hot plate 40 and heat sink 42. The hot plate 40 is thermally coupled to the exterior of the exhaust duct 48 and to the extension 46. The extension 46 extends to within the interior of the exhaust duct 48. The exhaust duct 48 is used to convey hot gases that are produced during an electrochemical aluminum production process. Thus, the thermoelectric generator layer 38 is coupled between a temperature gradient created by the heat conducted to the hot plate 40, and a cooler temperature created as a result of the heat sink 42. As is known in the art, the thermoelectric generator layer 38 uses the temperature difference to generate electric energy.

The thermistor 20 is attached to the end of the extension 46 and is used to measure the temperature of gas inside of the duct 48. This temperature measurement can be used to improve the efficiency of the aluminum production process, detect hazardous conditions, or for other purposes. Both the electrical outputs 52, 54 of the thermoelectric generator layer 38 and the signal 50 output of the thermistor 20 are provided to the node 14. The node 14 includes wireless communication electronics 30 to convey the measurement from the thermistor 20 to the computer system 16 for further analysis. The conveyance of sensor readings, such as temperature measurements provided by the thermistor 20, can be by any suitable means, wired or wireless. Furthermore, other types of sensors, such as blackbody radiation sensors, which are not disclosed herein, can be used.

Figure 2:
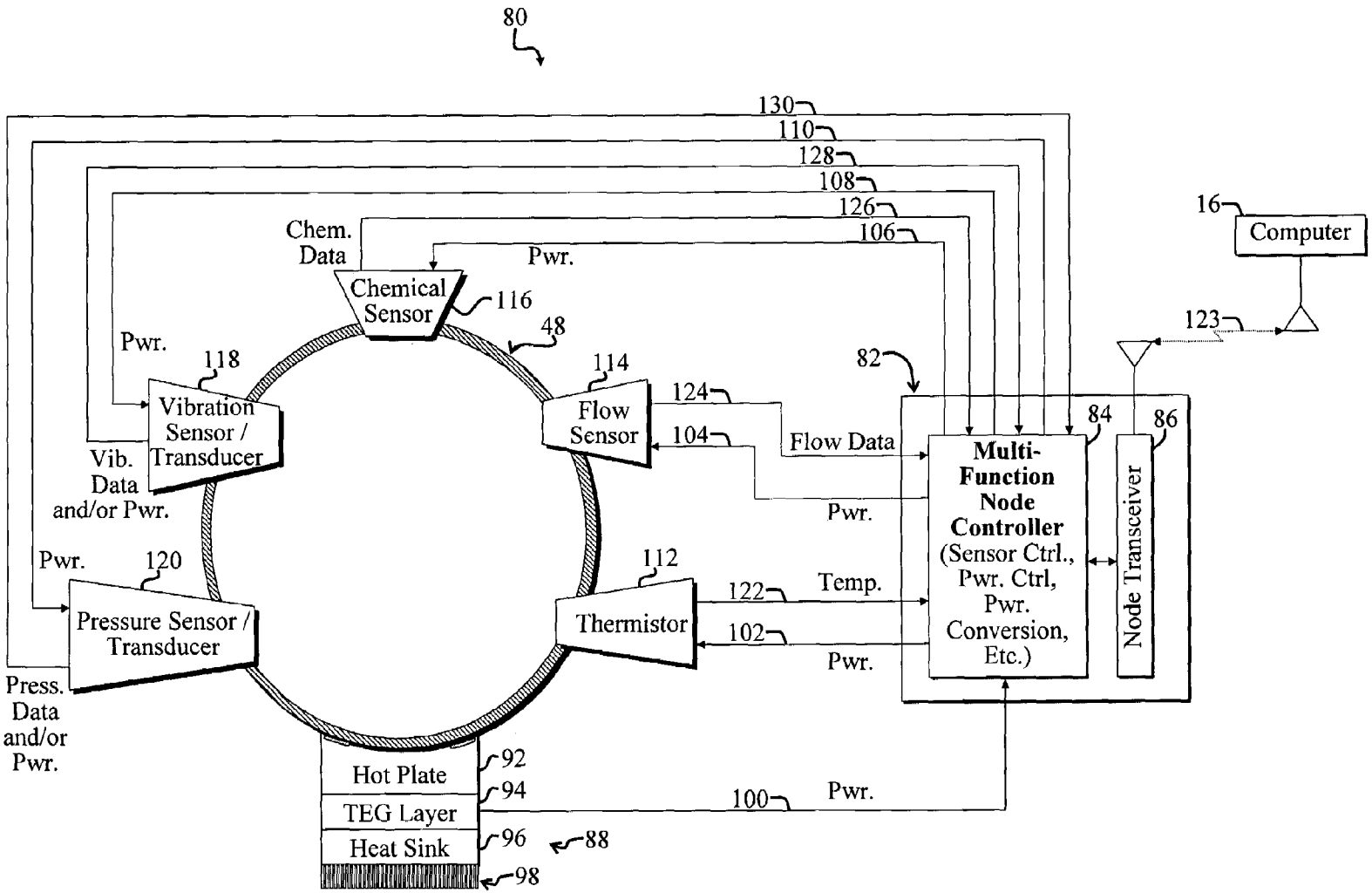
FIG. 2 is a diagram illustrating a second embodiment of the present invention adapted for use with a Hall-Héroult cell.

FIG. 2 is a diagram illustrating a second embodiment 80 of the present invention that is adapted for use with a Hall-Héroult cell (see 12 of FIG. 4) of which a cross-section of the exhaust duct 48 is shown in FIG. 2. The sensing system 80 includes an alternative sensor node 82 that includes an alternative multi-function controller 84 and transceiver 86. The multi-function controller 84 is powered by an alternative thermoelectric generator assembly 88. The curved hot plate 92 conforms to the shape of the exterior surface of the exhaust duct 48.

The thermoelectric generator assembly 88 further includes an alternative thermoelectric generator layer 94 that is sandwiched between the curved hot plate 92 and a special heat sink 96. For illustrative purposes, the special heat sink 96 is shown including crosscut cooling fins 98. The thermoelectric generator layer 94 employs a temperature difference between the hot plate 92 and the heat sink 96 to generate a power signal 100, which provides power to the multi-function node controller 84. The multi-function node controller 84 incorporates a DC/DC power converter that receives the varying power signal 100 and provides stable power to power the controller 84 in response thereto.

For illustrative purposes, the multi-function controller 84 is shown selectively providing power and control signals (pwr./ctrl.) 102-110 to a thermistor plug 112, a flow sensor 114, a chemical sensor 116, a vibration sensor/transducer 118, and a pressure sensor 120, respectively. The sensors 112-120 are connected to and/or penetrate into the exhaust duct 48 as needed to take sensor measurements, such as chemical, gas-flow, heat flux measurements, vibration, and pressure measurements. The multi-function controller 84 receives sensed data, such as chemical, gas-flow, temperature, vibration, and pressure measurements 122-130, respectively, from the sensors 112-120, respectively. The thermistor 112 may provide heat flux measurements in addition to temperature measurements. Alternatively, heat flux measurements are provided to the multi-function node controller 84 by the TEG layer 94.

In operation, the multi-function controller 84 selectively queries the sensors 112-120 for sensed data as needed in response to queries/control signals 123 received by the node 82 from the computer 16 and forwarded to the sensors 112-120. The computer 16 may also forward a control signal 123 to the multi-function controller 84 directing the multi-function controller 84 to adjust the power provided to one or more of the sensors 112.

The multi-function controller 84 selectively provides power to the sensors 112-120 when corresponding sensed data needs to be received by the node 82, such as in response to queries from the computer 16 or in response to predetermined criteria. For example, the multi-function controller 84 may be configured to periodically power-on one or more of the sensors 112-120 to receive corresponding sensed data. For the purposes of the present discussion, sensed data may be any information corresponding to measurements taken by a sensor, such as one or more of the sensors 112-120.

The multi-function controller 84 and sensors 112-120 may be configured so that the multi-function controller 84 continuously receives sensed data from the sensors 112-120, not just periodically or in response to queries, without departing from the scope of the present invention. Furthermore, the multi-function controller 84 may implement one or more routines that cause sensed data from one or more of the sensors 112-120 to only be stored by the node 82 and/or forwarded to the computer 16 when certain criteria are met. For example, if sensed data surpass predetermined thresholds or fall within predetermined thresholds as determined by the multi-function controller 84, then the data may be collected along with time stamps indicating when the measurements were received by the multi-function controller 84.

The exact configuration of the multi-function controller 84 and the routines and functions associated therewith are application specific. The functionality of the multi-function controller 84 may be adjusted by those skilled in the art with access to the present teachings to meet the demands of a given application without undue experimentation. For example, in one implementation, the multi-function controller 84 may be configured to wirelessly transmit an alarm signal to the computer 16 when the temperature within the exhaust duct 48 surpasses a predetermined maximum temperature threshold. The multi-function controller 84 may also be configured to power-off certain sensors 112-120 when power levels output by the thermoelectric generator assembly 88 are insufficient to power all of the sensors 112-120.

In an alternative operative scenario, various sensors, such as the vibration sensor 118 and the pressure sensor 120 can provide operational data about the process, which is then linked to the multi-function controller 84. Such sensors can be powered by conventional batteries. In other scenarios, energy scavenging from heat, vibration or pressure differential could be used to power the various kinds of sensor. Hence, various sensors 112-120 may be powered by scavenging waste heat or vibration from the alumina-reduction process occurring within the Hall-Héroult cell 12 (see FIG. 1).

Hence, the sensing system 80 of FIG. 2 implements a system for obtaining information pertaining to a process or thing, such as an aluminum-reduction process occurring in the Hall-Héroult cell 12 of FIG. 1. The sensing system 80 includes one or more energy converters implemented by the thermoelectric generator assembly 88 and one or more of the sensors 112-120. For the purposes of the present discussion, an energy converter may be any device that is adapted to convert energy from a process or thing, such as a process or device being measured, into energy suitable for use by a circuit or associated device, such as the node 82 and one or more of the sensors 122-120, respectively.

The sensing system 80 further includes a sensor, such as one or more of the sensors 122-120, coupled to the process or thing 48. The node 82 is coupled to the sensor 112-120 and the energy-converter 88, wherein the node 82 is powered by output from the energy converter 88.

The multi-function controller 84 implements one or more routines for selectively adjusting power to the wireless transmitter 86 of the node 82 in response to a predetermined condition, such as values output from the sensor 112-120 being within a predetermined range or below or above a predetermined threshold. The predetermined condition may include electrical energy 100, which is output from the energy converter 88, being below a predetermined threshold. The remote computer 16 may include one or more routines 64 that are adapted to process information output by the sensor 112-120.

Figure 3:
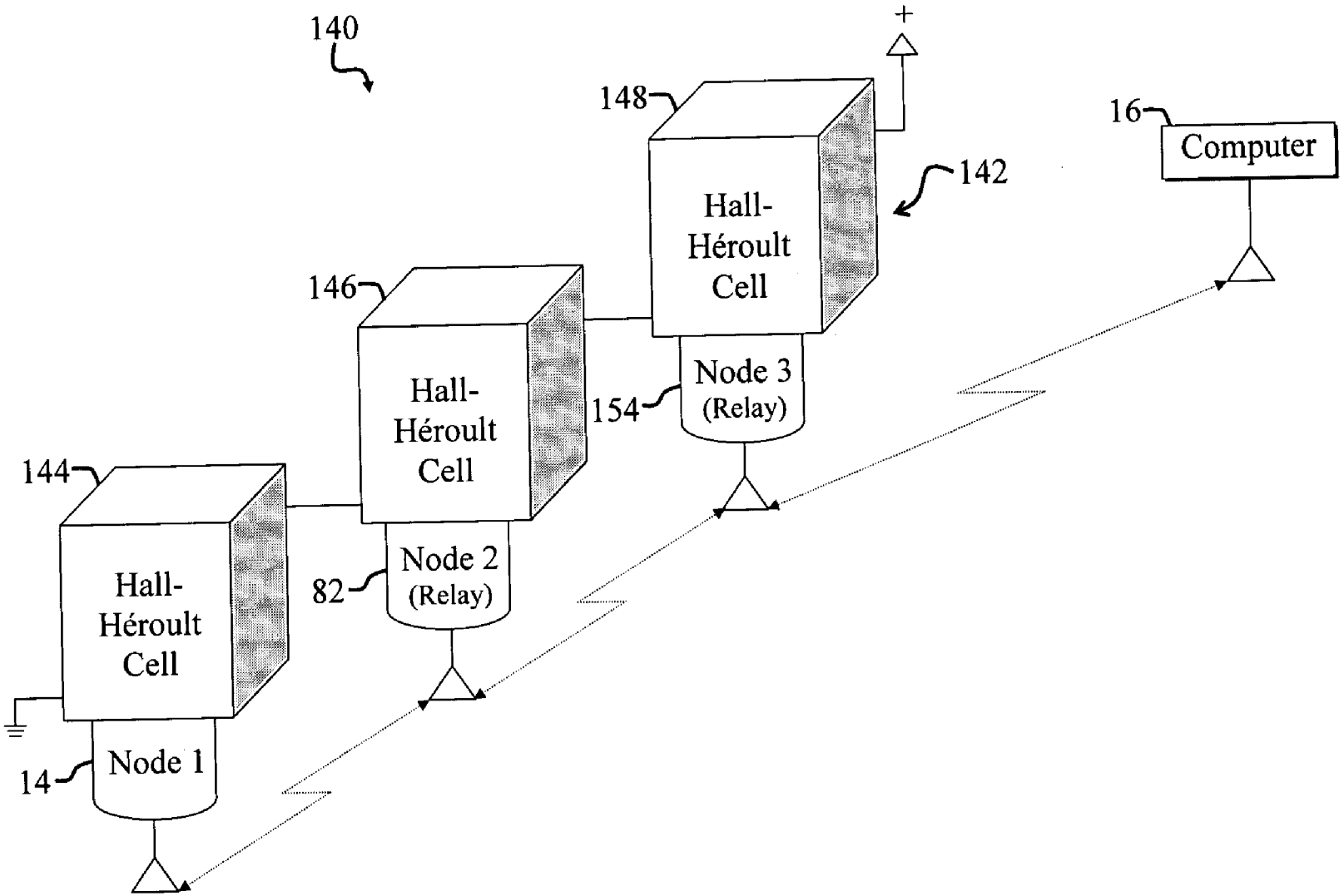
FIG. 3 is a diagram illustrating a third embodiment of the present invention adapted for use with a Hall-Héroult potline.

FIG. 3 is a diagram illustrating a third embodiment 140 of the present invention that is adapted for use with a Hall-Héroult potline 142. The potline 142 includes plural Hall-Héroult cells 144-148, which are connected in series. Plural sensor nodes 14, 82, 154 are connected to or otherwise are configured to obtain sensed data associated with the cells 144-148, respectively, from corresponding sensors (see FIGS. 1 and 2). The sensed data may be wirelessly forwarded to the computer 16 directly. Alternatively, certain nodes, such as the second node 82 and the third node 154 may act as relays to relay signaling information, such as, but not limited to, sensed data from other nodes, such as the first node 14 and/or the second node 82.

In certain operative scenarios, the first node 14 may transmit information to the third node 154, thereby hopping the second node 82. Alternatively, the second node 82 may transmit directly to the computer 16, thereby hopping the third node 154. Alternatively, the first node 14 may communicate directly with the computer 16, thereby hopping the second node 82 and the third node 154. Exact details and conditions pertaining to which nodes are hopped are application specific. Functionality required to implement node hopping is known in the art and may be readily employed in the nodes 14, 82, 154 by those skilled in the art with access to the present teachings without undue experimentation.

Use of the wireless nodes 14, 82, 154, which do not require separate bulky battery packs or wall-outlet extension cords, greatly facilitates instrumentation of the potline 142. Use of the sensing system 140 may improve the ability of alumina-reduction plants to safely and accurately monitor Hall-Héroult cell processes, thereby providing valuable information that may be used to improve aluminum manufacturing.

Figure 4:
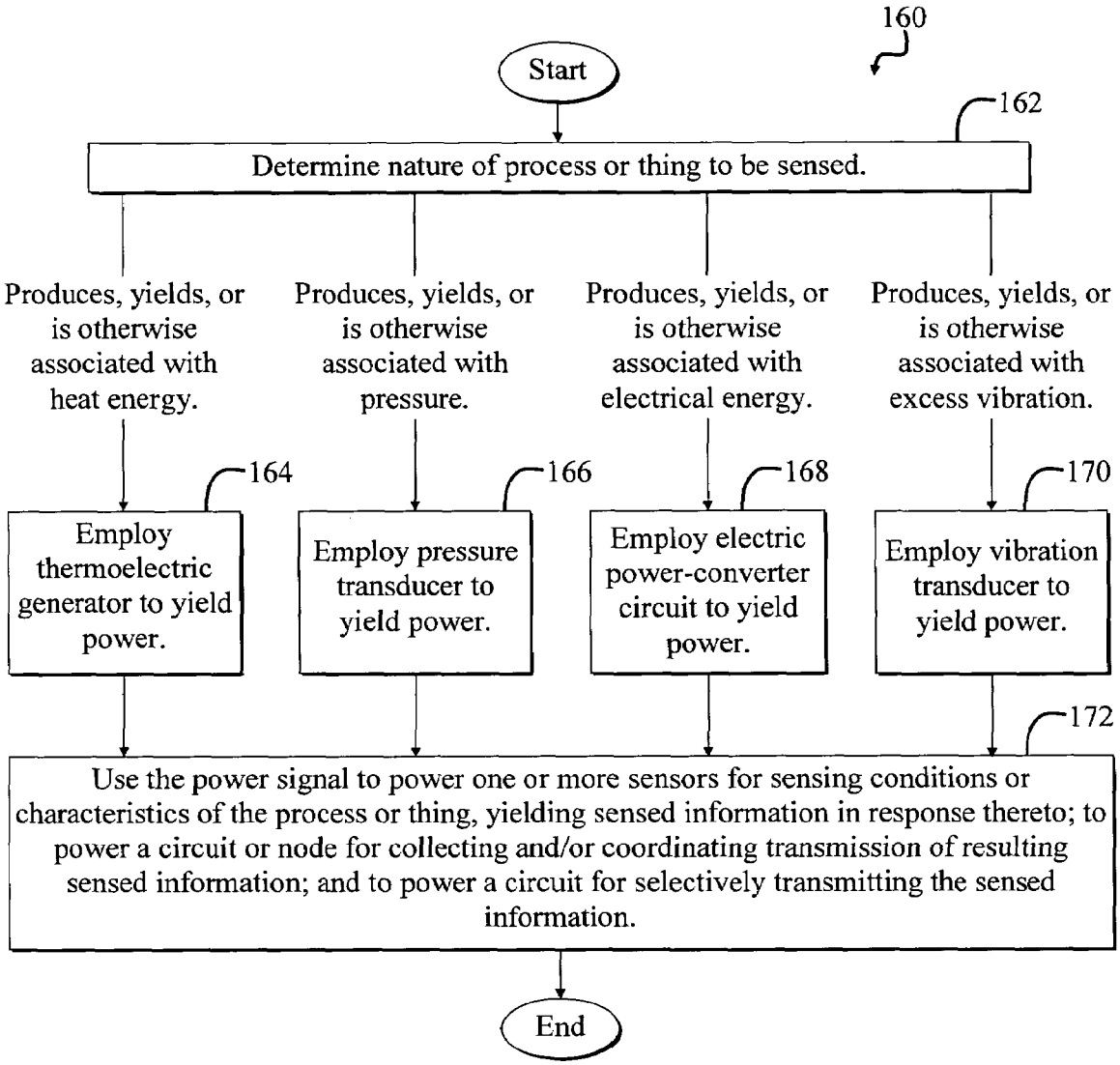
FIG. 4 is flow diagram of a method adapted for use with the embodiments of FIGS. 2-3.

FIG. 4 is flow diagram of a method 160 adapted for use with the embodiments of FIGS. 2-3. The method 160 includes an initial environment-determination step 162, wherein the nature of the process, device, or object being sensed is determined.

If the environment-determination step 162 determines that the process or thing being sensed produces or yields waste energy in the form of heat, then a thermoelectric generator, such as the thermoelectric generator 88 of FIG. 2, is selected for use in an associated sensing system in a thermoelectric-generator-selecting step 164.

If the environment-determination step 162 determines that the process or thing being sensed produces or yields excess pressure, then a pressure transducer, such as the transducer 120 of FIG. 2, is selected for use in an associated sensing system in a transducer-selecting step 166.

If the environment-determination step 162 determines that the process or thing being sensed produces or yields excess vibration, then a vibration transducer, such as the vibration transducer 118 of FIG. 2, is selected for use in an associated sensing system in a vibration-converting step 170.

If the environment-determination step 162 determines that the process or thing being sensed produces or yields excess electrical energy, then an electrical power converter, such as the cell-voltage measuring device 18 and converter 26 of FIG. 1, are selected for use in an associated sensing system in a power-converter-selecting step 168.

After the appropriate power-providing modules are selected in the selecting steps 164-168, then an energy-utilizing step 172 is performed. The energy-utilizing step 172 involves using power and/or electrical-energy from the thermoelectric generator, the pressure transducer, and/or the power converter selected in the selecting steps 164-168 to power one or more sensors that are adapted to sense conditions or characteristics pertaining to the process or thing being sensed. The energy-utilizing step 172 also involves using power and/or electrical-energy to power a circuit, such as a node, for collecting and/or coordinating the transmission of sensed data output from the sensors. The energy-utilizing step 172 also involves using power and/or electrical-energy to power a communications module, such as the node transceiver 80 of FIG. 2, to selectively transmit the sensed data to another node and/or to remote computer, such as the computer 17 of FIGS. 1-3.

With reference to FIGS. 1-4, while embodiments of the present invention have been discussed with respect to specific arrangements of sensors, nodes, and computers, embodiments of the present invention are not limited thereto. Sensors, nodes, heat sinks, thermoelectric generators and other components can be used in different arrangements. For example, various sensors maybe mounted onto a different portion of the cell 12 other than the exhaust duct 48. Furthermore, the invention can be adapted to work with processes other than aluminum reduction.

In general, the electrical energy generation may be achieved via various types of energy converters other than thermoelectric generators, pressure transducers, and so on. Furthermore, wireless transmission can be used to monitor any suitable process or condition. For example, embodiments of the invention can be adapted to work with other electrochemical processes including modifications to an aluminum reduction process.

Note that specific numbers, types, arrangements and other characteristics of devices and systems can vary from those described herein. In general, features of embodiments of the invention can work with any suitable types of network devices, topology, protocol, physical links, etc. Examples of communications standards that may be employed to facilitate wireless communications between nodes and computers include, but are not limited to Institute of Electrical and Electronics Engineers (IEEE) standards 802.11x (where "x" may be "b", "g", etc.), 802.16, and Bluetooth. Nodes can be used to relay information to other nodes and eventually to a central processing station such as the computer 16 (or other processing system) as described in the attached Papers.

The sensors can be of various types, sizes, mountings, or other characteristics. For example, position, temperature, moisture or humidity, gas pressure, force, light, and other sensors can all be used. A single node can have multiple sensors and different nodes can use different numbers and types of sensors than other nodes. Depending on the type of application, different types of sensing may be more desirable than others, and sensor characteristics such as sensitivity, ruggedness, sample rate, power consumption, transmit/receive range, etc., may be more critical than others.

Nodes can have pre-programmed behavior so that the need for transmitting commands to a node is reduced. Another option is to allow each node to be reprogrammable so that node behavior, such as sensor sampling rate, transmit range, communications relay ability, etc., can be adjusted from a control center. Node firmware and software can be downloaded to each node from a control center, server or other device.

One embodiment of the invention can-use a base station to send and receive signals among a network of nodes. The base station can be configured to perform different functions such as aggregating and correlating data, filtering data, monitoring nodes, etc. The base station, which may be implemented via the computer 16 of FIGS. 1 and 2, can act as a central radio-frequency receiver/transmitter and relay information to other processing-system servers which, in turn, can provide data from the nodes to other client computer systems. Client systems can operate automatically or in interaction with human operators to analyze data, monitor and report on conditions, make predictions and issue commands to the nodes. Note that in practice several or many base stations can be used, each with an associated plurality of nodes. Base station coverage can overlap to provide robustness via redundancy. Such overlapping coverage can also improve overall bandwidth of communications from and to nodes.

Sensors on nodes can be prioritized so that if there is a lack of resources (e.g., limited bandwidth), the sensor readings with higher priority can be communicated first. Data of sensor types with lower priority can be buffered and transmitted when there is free bandwidth at a later time, or discarded and not sent at all. If a node starts to become low on power, sensors with higher priority can remain active while lower priority sensors are shut down.

Sensing can be triggered or controlled or modified in reaction to events or other criteria. For example, where a sensor reading is within an expected "normal" range then a node can be programmed to report infrequently. If readings exceed a threshold value then the node can send readings or an alert message at a high priority. The node can begin sampling more frequently and give the appropriate sensor a higher priority. When the condition becomes safe (i.e., does not exceed the threshold) the node and sensing operation can go back to the previous state.

One sensor's reading can be used to modify the operation and reporting of other sensors. For example, if temperature increases, then gas flow monitoring can be increased in frequency, reporting priority, etc.

Although the invention has been discussed with respect to specific embodiments thereof, these embodiments are merely illustrative, and not restrictive, of the invention. Additional types of sensors include imaging sensors (e.g., cameras), infrared sensing, etc. Any software applications or functionality can be provided at the node, base station, servers and/or clients. It is anticipated that third-party commercial software can be used to perform functions such as database storage and retrieval, data transfer, data analysis, operating system functions, etc.

Although embodiments of the invention have been presented primarily with respect to electrochemical production, other uses are possible. Different configurations of sensors, power generators, receivers, transmitters and control systems are possible. For example, one type of useful configuration is a relay system that can use an electric generator and a receiver/transmitter node to receive a signal from an originating node and to relay it to another receiver that may be too distant too communicate directly with the originating node.

While the present embodiments are discussed with reference to obtaining measurements pertaining to conditions or characteristics of an aluminum reduction cell or process, embodiments of the present invention are not limited thereto. For example, many types of environments are susceptible to events that may affect sensor output and that would benefit from a sensor network and accompanying sensed-data collection method implemented according to an embodiment of the present invention.

Although a process or module of the present invention may be presented as a single entity, such as software executing on a single machine, such software and/or modules can readily be executed on multiple machines. Furthermore, multiple different modules and/or programs of embodiments of the present invention may be implemented on one or more machines without departing from the scope thereof.

Any suitable programming language can be used to implement the routines or other instructions employed by various network entities. Exemplary programming languages include nesC, C++, Java, assembly language, etc. Different programming techniques can be employed such as procedural or object oriented. The routines can execute on a single processing device or multiple processors. Although the steps, operations or computations may be presented in a specific order, this order may be changed in different embodiments. In some embodiments, multiple steps shown as sequential in this specification can be performed simultaneously.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

A "machine-readable medium" or "computer-readable medium" for purposes of embodiments of the present invention may be any medium that can contain, store, communicate, propagate, or transport the program for use by or in connection with the instruction execution system, apparatus, system or device. The computer readable medium can be, by way of example only but not by limitation, an electronic, magnetic, optical, electromagnetic, infrared, or semiconductor system, apparatus, device, propagation medium, or computer memory.

A "processor" or software "process" includes any human, hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems. A computer may be any processor in communication with a memory.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow "a", "an", and "the" include plural references unless the context clearly dictates otherwise. Furthermore, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. An apparatus for sensing a condition of a system, the apparatus comprising:

an energy-converter coupled to the system through an exhaust duct coupled to the system, the system performing a metal production or processing process in which a reaction yields a metal substance and generates waste energy in the form of a hot gas from operation of the process being sensed by the sensor, the hot gas being conveyed away from the process being performed in the system through the exhaust duct to the energy-converter, wherein the energy-converter is configured to generate thermoelectric energy from the waste energy in the form of hot gas;

a sensor coupled to the system to sense a condition of the metal production or processing process; and a node coupled to the sensor and the energy-converter, wherein the node is powered by the thermoelectric energy generated and output from the energy converter, the node configured to receive information for the sensed condition of the metal production or processing process from the sensor.

2. The apparatus of claim 1 wherein the energy-converter includes a thermoelectric generator.

3. The apparatus of claim 1 wherein the sensor includes a temperature sensor, a current sensor, a voltage sensor, a heat flux sensor, a chemical sensor, a pressure sensor, and/or a vibration sensor.

4. The apparatus of claim 1 wherein the node includes a wireless transmitter.

5. The apparatus of claim 4 wherein the node includes a controller wherein the controller implements one or more routines for selectively adjusting power to the wireless transmitter and/or to a receiver in response to a predetermined condition.

6. The apparatus of claim 5 wherein the predetermined condition includes, values output from the sensor being within a predetermined range or below or above a predetermined threshold.

7. The apparatus of claim 5 wherein the predetermined condition includes electrical energy, which is output from the energy converter, being below a predetermined threshold.

8. The apparatus of claim 6 wherein the predetermined condition includes a signal from the remote conputer.

9. The apparatus of claim 4 further including a remote computer wirelessly coupled to the node via the wireless transmitter and/or receiver.

10. The apparatus of claim 9 wherein the remote computer includes one or more routines adapted to process information output by the sensor.

11. An apparatus for obtaining information pertaining to a system, the apparatus comprising:

means for performing a metal production or processing process in which a reaction yields a metal substance and generates waste energy in the form of a hot gas from operation of the process being sensed by the sensor;

first means for employing the waste energy from the system to generate a signal, the hot gas being conveyed away from the process being performed in the system through the exhaust duct to the energy-converter, wherein the first means is configured to generate thermoelectric energy from the energy in the form of hot gas;

second means for sensing a condition pertaining to the-metal production or processing process being performed by the system and providing sensed information in response thereto;

third means for collecting the sensed information; and fourth means for employing the first means to power the second means and/or the thirdd means using the thermoelectric energy.

12. The apparatus of claim 11 wherein the third means includes a sensor node.

13. The apparatus of claim 12 wherein the energy includes waste energy.

14. The apparatus of claim 12 wherein the waste energy includes heat energy.

15. The apparatus of claim 11 wherein the sensor node includes a wireless transmitter/receiver.

16. The apparatus of claim 15 wherein the second means includes a temperature sensor, a chemical sensor, a pressure sensor, a heat flux sensor, a gas-flow sensor, a voltage sensor, and/or a current sensor.

17. The apparatus of claim 15 wherein the sensor node includes a node controller, the node controller being adapted to selectively adjust power to the wireless transmitter based on one or more predetermined conditions.

18. The apparatus of claim 17 wherein the one or more predetermined conditions include a power level associated with the signal being below a predetermined threshold.

19. The apparatus of claim 17 wherein the one or more predetermined conditions include sensor-output status.

20. The apparatus of claim 11 wherein the energy output by the process includes heat energy.

21. The apparatus of claim 20 wherein the first means includes a thermoelectric generator adapted to convert heat energy output by the process into the thermoelectric energy.

22. An apparatus comprising:

means for performing a metal production or processing process in which a reaction yields a metal substance and generates waste energy in the form of a hot gas from operation of the process being sensed by the sensor;

first means for employing waste energy from the process to generate a signal, the hot gas being conveyed away from the metal production or processing process being performed in a system through the exhaust duct to the energy-converter, wherein the first means is configured to generate thermoelectric energy from the energy in the form of hot gas;

second means for sensing a condition pertaining to the metal production or processing process and providing sensed information in response thereto;

thirdd means for collecting the sensed information; and fourth means for employing the first means to power the second means and/or the third means using the thermoelectric energy.

23. An apparatus comprising:

a sensor for sensing a characteristic of a metal production or processing process;

a thermoelectric generator having first and second temperature sources, wherein the first temperature source is coupled to an exterior surface of a system performing the metal production or processing process in which a reaction yields a metal substance, the process being sensed by the sensor and the second temperature source is obtained from a second surface separate from surfaces of the system, the second temperature source being at a lower temperature then the first temperature source; and a wireless transmitter coupled to the thermoelectric generator and the sensor, wherein the wireless transmitter obtains power from the thermoelectric generator for transmitting an indication of the snesed characteristic from the sensor to a receiver.

24. The apparatus of claim 23, wherein the sensor includes a temperature sensor.

25. The apparatus of claim 23, wherein the sensor includes a pressure sensor.

26. The apparatus of claim 23, wherein the sensor includes a flow sensor.

27. The apparatus of claim 23, wherein the sensor includes a chemical sensor.

28. The apparatus of claim 23, wherein the sensor includes a vibration sensor.

29. The apparatus of claim 23, wherein the sensor includes a measurement of electrical current through or within a cell or its superstructure.

30. The apparatus of claim 23, wherein the sensor includes a measurement of voltage within a cell or its superstructure.

31. The apparatus of claim 23, wherein the sensor includes a measurement of heat flux through the exterior of a cell.

32. The apparatus of claim 23, further comprising:

a duct having an interior and exterior, wherein the first temperature source is derived from the interior of the duct and wherein the second temperature source is derived from the exterior of the duct.

33. The apparatus of claim 32, further comprising:

aheat sink positioned at least in part in the exterior of the duct.

34. The apparatus of claim 32, further comprising:

a hot plate thermally coupled to the interior of the duct.

35. A method for obtaining a sensor reading, the method comprising:

receiving waste energy in the form of a hot gas from operation of a metal production or processing process in which a reaction yields a metal substance and the hot gas, the process being sensed by a sensor, the hot gas being conveyed away from the process being performed in a system through an exhaust duct to the energy-converter;

using a thermoelectric generator to generate electrical energy, wherein the thermoelectric generator generates the electrical energy from the waste energy in the form of hot gas;

using the sensor to measure a characteristic of the system performing the metal production or processing process; and using a wireless transmitter powered by the electrical energy to transmit the measured characteristic.

36. The method of claim 35, wherein the sensor includes a temperature sensor.

37. The method of claim 35, wherein the sensor includes a pressure sensor.

38. The method of claim 35, wherein the sensor includes a flow sensor.

39. The method of claim 35, wherein the sensor includes a chemical sensor.

40. The method of claim 35, wherein the sensor includes a vibration sensor.

41. The method of claim 35, wherein the sensor includes a measurement of electrical current.

42. The method of claim 35, wherein the sensor includes a measurement of voltage.

43. The method of claim 35, wherein the sensor includes a measurement of heat flux.

44. An apparatus comprising:

a thermoelectric generator having first and second temperature sources, wherein the thermoelectric generator generates electrical power from a temperature differential between the first and second temperature sources, the first temperature source being obtained from a coupling to the exterior surface of a system performing a metal production or processing process in which a reaction yields a metal substance and the second temperature source is obtained from a second surface separate from surfaces of the system, the second temperature source being at a lower temperature than the first temperature source; and a wireless transmitter coupled to the thermoelectric generator, wherein the wireless transmitter obtains power from the thermoelectric generator for relaying a signal to another receiver.

45. The apparatus of claim 1, wherein the metal production or processing process comprises an aluminum production or processing process.

46. The apparatus of claim 11, wherein the metal production or processing process comprises an aluminum production or processing process.

47. The apparatus of claim 22, wherein the metal production or processing process comprises an aluminum production or processing process.

48. The apparatus of claim 23, wherein the metal production or processing process comprises an aluminum production or processing process.

* * * * *